US005848333A

United States Patent [19]

An

[11] Patent Number: 5,848,333

[45] Date of Patent: Dec. 8, 1998

[54] DRIVING SYSTEM FOR AN APPARATUS USING ELECTROPHOTOGRAPHIC DEVELOPMENT

[75] Inventor: Byung-sun An, Kyungki-do, Rep. of Korea

[73] Assignee: Samsung Electronics Co., Ltd., Rep. of Korea

[21] Appl. No.: 694,708

[22] Filed: Aug. 9, 1996

[30] Foreign Application Priority Data

Aug. 9, 1995 [KR] Rep. of Korea ..... 95-24574

[51] Int. Cl.[6] ..... G03G 15/00; G03G 21/00

[52] U.S. Cl. ..... 399/167; 399/222

[58] Field of Search ..... 399/36, 167, 222, 399/394

[56] References Cited

U.S. PATENT DOCUMENTS 3,790,270 2/1974 Donohue ..... 399/394 X
4,320,954 3/1982 Ikeda et al. ..... 399/222 X
4,522,483 6/1985 Matsumoto et al. ..... 399/167
5,294,958 3/1994 Isobe et al. ..... 399/167 X
5,459,553 10/1995 Kim ..... 399/36 X

*Primary Examiner*—Fred L. Braun
*Attorney, Agent, or Firm*—Banner & Witcoff, Ltd.

[57] ABSTRACT

A driving system for use in an apparatus utilizing electrophotographic development, such as a copier, wherein a main motor is provided to drive respective power transmission gears. The driving system includes a two-stepped driving system unit to lessen the live load when the system is initially powered to reduce wear of the gears, blur or spread of a printed image. A main motor of relatively lower capacity is able to be incorporated in the system, thereby enhancing product performance and reducing overheads. When the system is initially powered, a sensitization body, a pickup roller, a fixing and a feed are driven by power transmitted from a main motor. Then, after the torque load of the rotating parts is stabilized, the remaining parts of the apparatus (e.g., a developing part and a register roller) are driven. In an alternative embodiment, a pickup roller, a fixing roller and a feed roller are initially driven, and thereafter, following the stabilization of torque, a sensitization body, a developing part and a register roller are driven. A clutch is employed to interrupt power transmission.

8 Claims, 6 Drawing Sheets

DRIVING SYSTEM FOR AN APPARATUS USING ELECTROPHOTOGRAPHIC DEVELOPMENT

CROSS-REFERENCE TO RELATED APPLICATIONS

This application makes reference to, incorporates herein and claims all benefits accruing under 35 U.S.C§119 from our patent applications entitled DRIVING SYSTEM FOR USE WITH AN APPARATUS USING ELECTROPHOTOGRAPHIC DEVELOPMENT earlier file in the Korean Industrial Property Office on Aug. 9, 1995, and assigned Ser. No. 95-24574 by that Office

BACKGROUND OF THE INVENTION

1. Field of the Invention

The present invention relates in general to a driving unit for use in an apparatus utilizing electrophotographic development such as a copier, and more particularly, to a driving system for an apparatus using electrophotographic development capable of reducing driving load at initial state.

2. Description of the Related Art

Generally, a well-known type of apparatus utilizing electrophotographic development typically comprises, as shown in FIG. 1, a sensitization body for forming an image, a source of light, a magazine roller in developing pare that develops toner in fine powder, a toner agitator for supplying fine powder to magazine roller, a transfer instrument, a cleaner, an electrified inductor, a combination of pickup roller and feed roller on a cassette, a register roller, fixing roller and a delivery roller. Such type of apparatus employs a single main motor for generating power to drive various rollers including sensitization body. FIGS. 2A and 2B illustrate, respectively, a block diagram showing sequential order of conventionally proposed apparatus driven by a main motor and a schematic side view of various types of gears engaged with each other.

More specifically, a conventional type apparatus drives various kinds of rollers by using power transmission means a plurality of power transmission gears and a couple of timing pulley and belt, starting from motor gear driven by main motor, in the sequential order of sensitization driven gear, cleaner gear, register roller gear, feed roller gear, agitator gear and fixing roller gear. In this context main motor is required to be of enough torque capacity in order to drive over head load.

In more detail, a main motor having more torque capacity than theoretical load value by two or three times is often selected to drive whole system, however, it is excessively overloaded at initial state in order to drive overall rollers since a plurality of power transmission gear and a couple of belt and pulley must be incorporated in the structure of the system. In consequence, even a main motor of enough capacity to bear the above mentioned load would suffer from an increased acceleration torque at initial state such that sudden wear occurs on respective gears and even worse, cracks and damages follow, thereby causing malfunction of a system.

In addition, on most occasions a step out phenomenon occurred to such main motor and a sharp load fluctuation followed. Namely, an instantaneous rotational velocity alteration of either pickup roller and register roller at initial state, causing a transcribed image to be spread or blurred due to inequality in developing and transcript. These drawbacks required an employment of high capacity main motor which eventually increases overheads and decreases product reliability.

SUMMARY OF THE INVENTION

Therefore, it is an object of the present invention to provide a driving system for use in an apparatus utilizing electrophotographic development capable of lessening load at initial state.

It is another object of the present invention to provide a driving system by which an apparatus utilizing electrophotographic development and incorporating the system is partially driven at initial state by passing though two stages.

In comparing the live load applied to respective portions of driving system, developing part is most heavily loaded, and fixing roller, pickup roller, register roller and then sensitization body is loaded lesser in sequential order. In addition, feed roller is the portion onto which least load is applied.

In view of above, according to one preferred embodiment of the principles of the present invention, sensitization body, pickup roller, fixing roller and feed roller are first selected as a group which is subject to be driven at initial state, and then, followed by a stabilization of driving torque, developing part and register roller are subsequently driven.

In addition, according to another preferred embodiment of the present invention, a selected group of pickup roller, fixing roller and feed roller is initially driven in order to quickly stabilize torque there of and subsequently remaining portions comprising sensitization body, developing part and register roller is driven.

Accordingly, according to the principles of the present invention, driving portions onto which relatively less live loads are applied are driven at initial state in order to minimize overall live load in driving system, and thereafter, following a stabilization of torque, remaining portions that require less live load are driven.

Description will hereunder be given of preferred embodiments of the present invention, with reference to the attached drawings.

DETAILED DESCRIPTION OF THE PREFERRED EMBODIMENT

Figure 1:
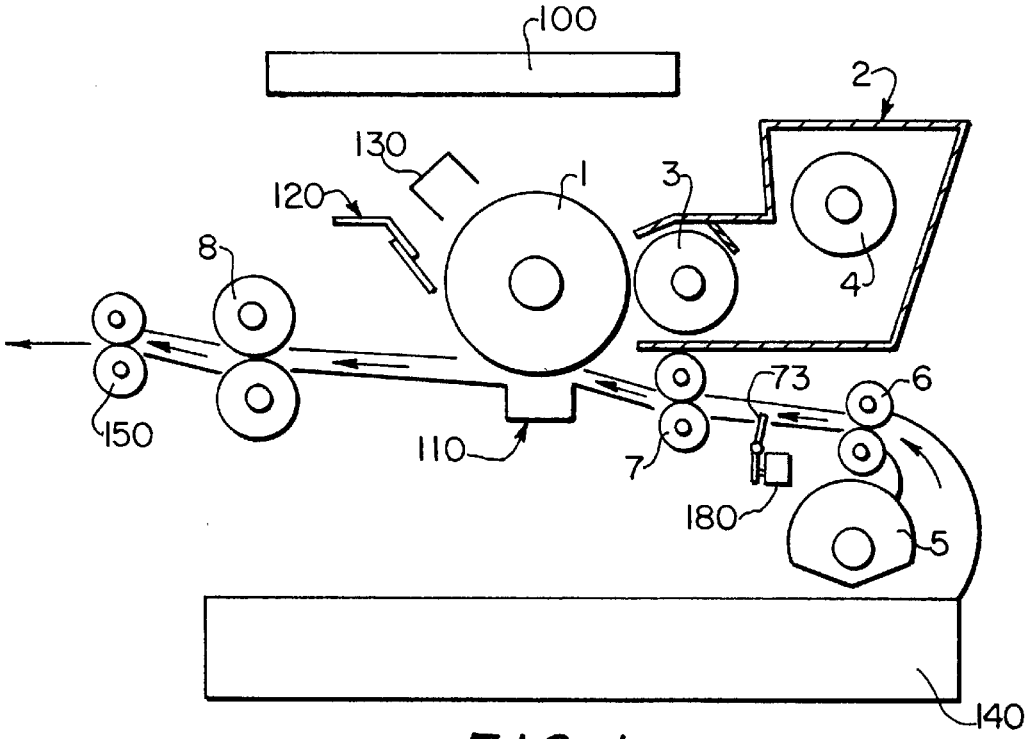
FIG. 1 is a schematic diagram illustrating conventional apparatus utilizing electrophotographic development, with parts removed for clarity and simplicity.
Figure 2B:
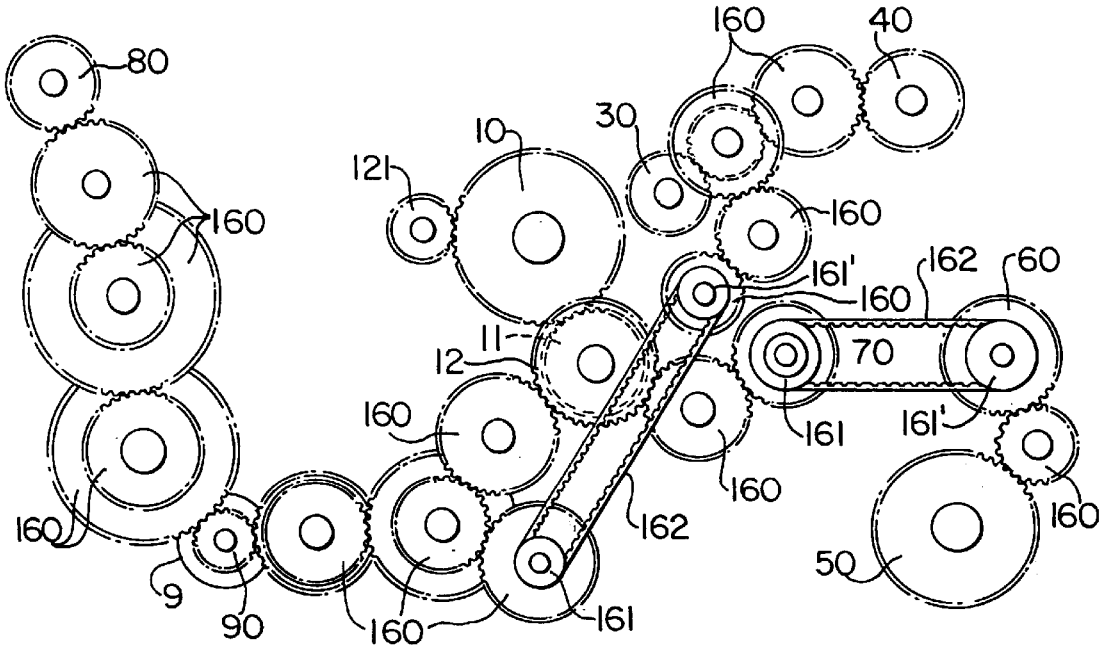
FIGS. 2A and 2B are, respectively, a driving systematic block diagram and schematic elevational view of driving unit, of conventional apparatus.
Figure 2A:
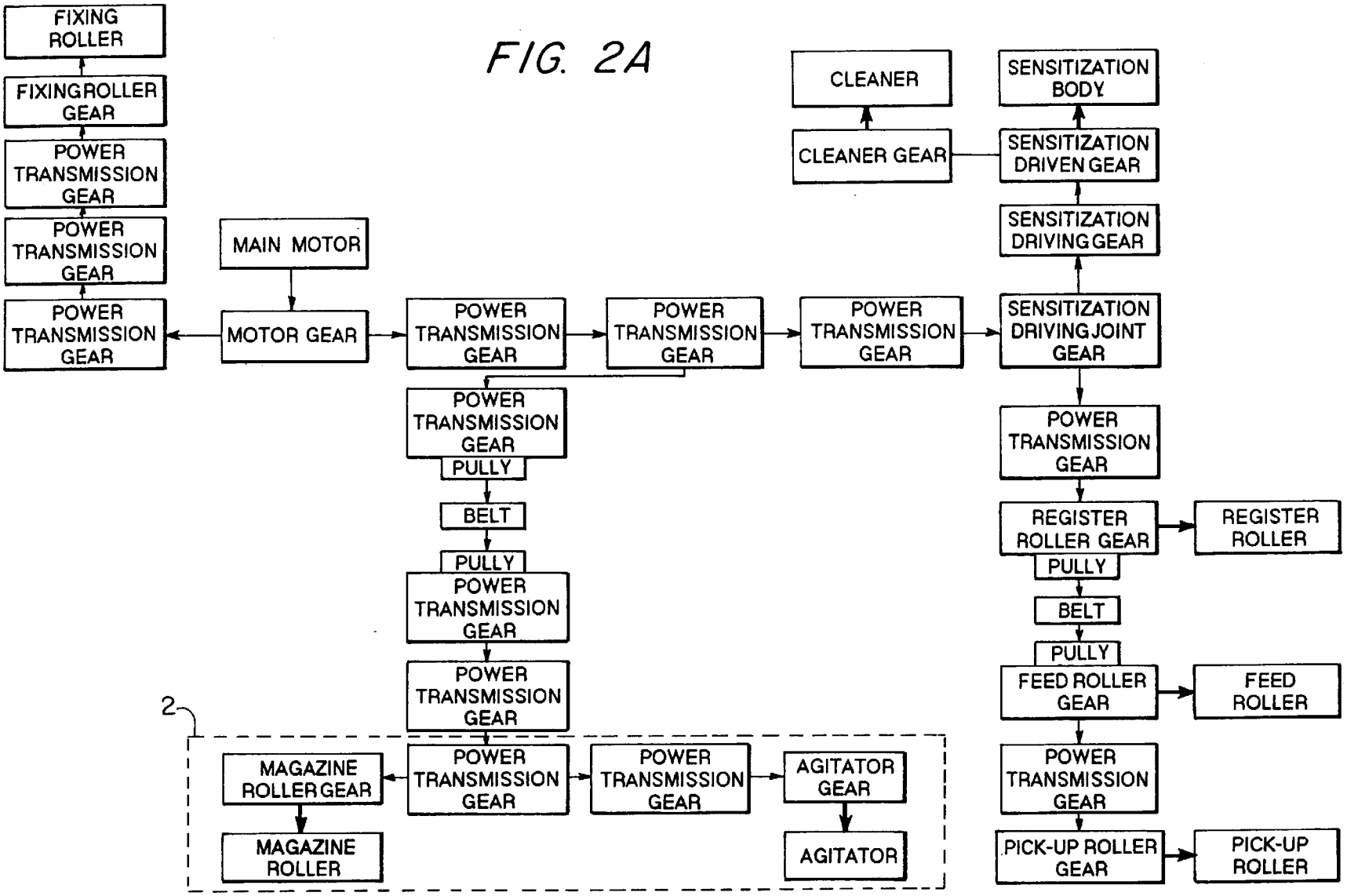
Figure 3:
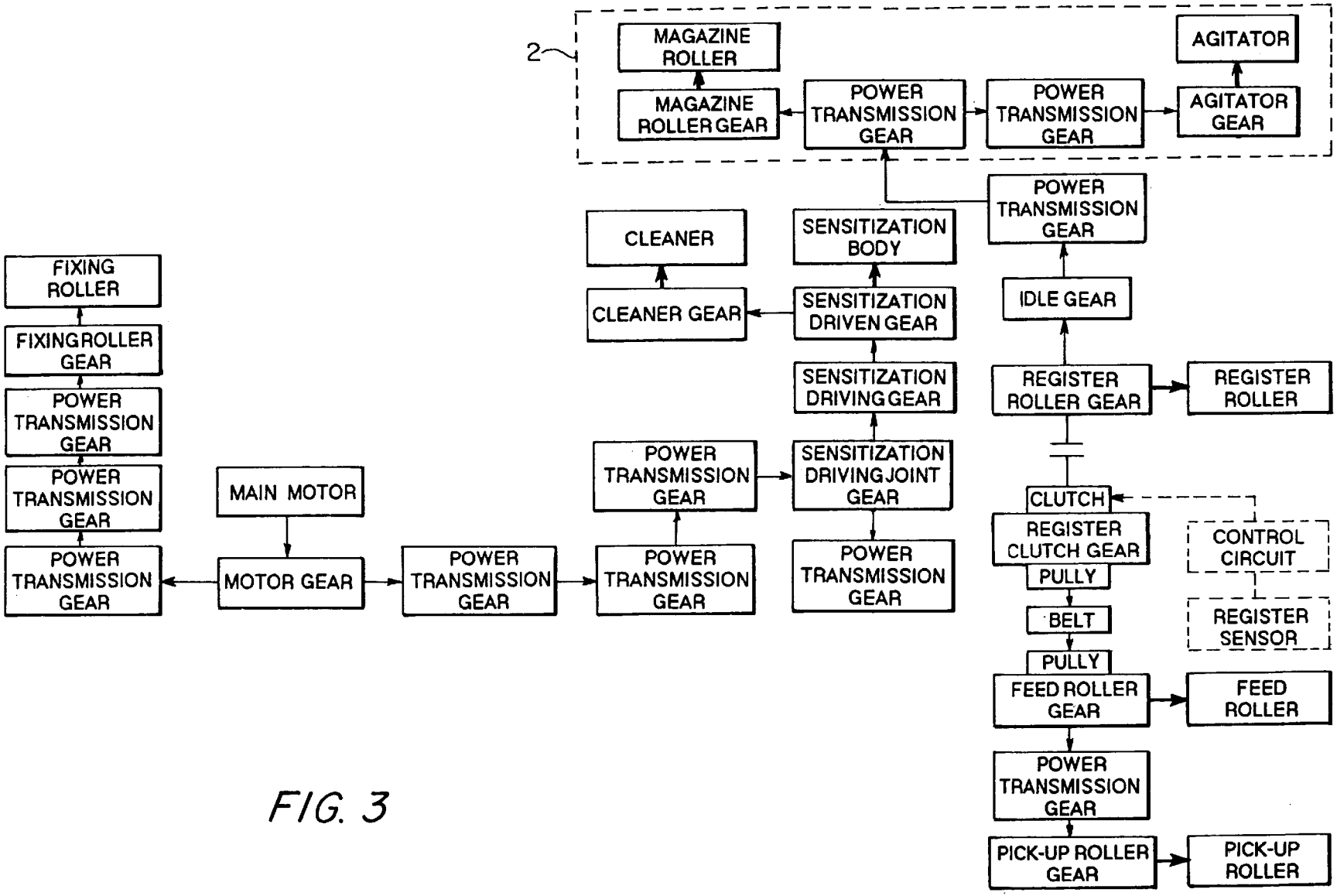
FIG. 3 is a block diagram illustrating a driving systematic drawing for one preferred embodiment according to the principles of the present invention.
Figure 4:
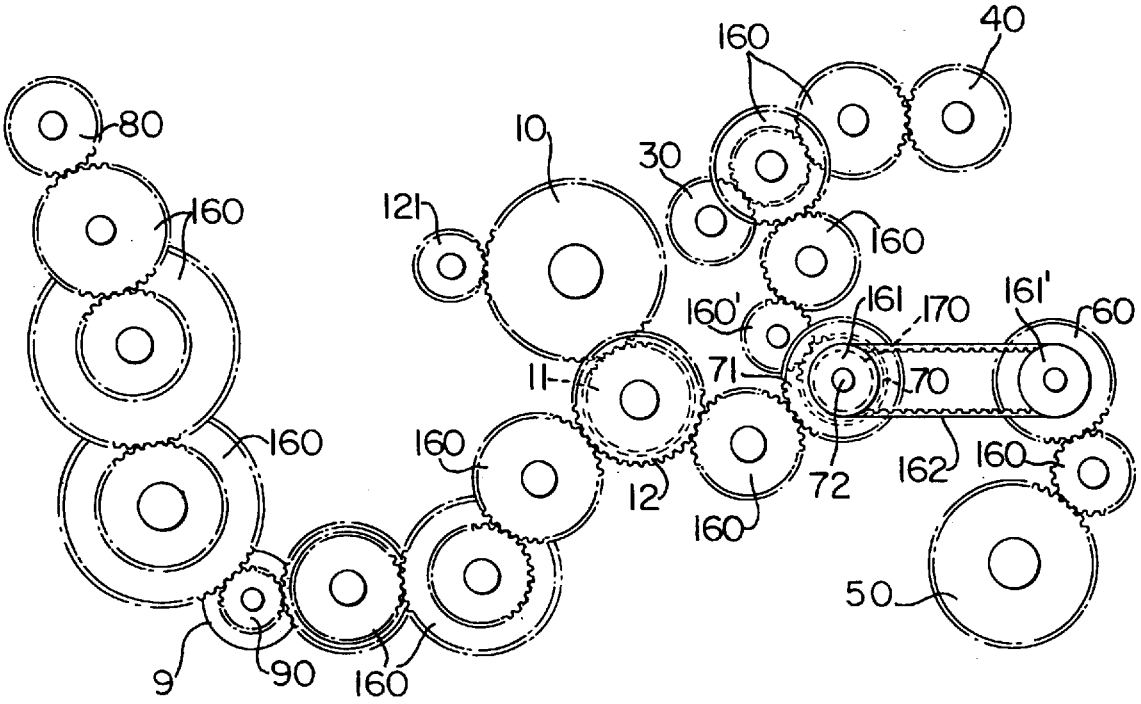
FIG. 4 is a schematic elevational view of a driving unit of the embodiment of FIG. 3.
Figure 5:
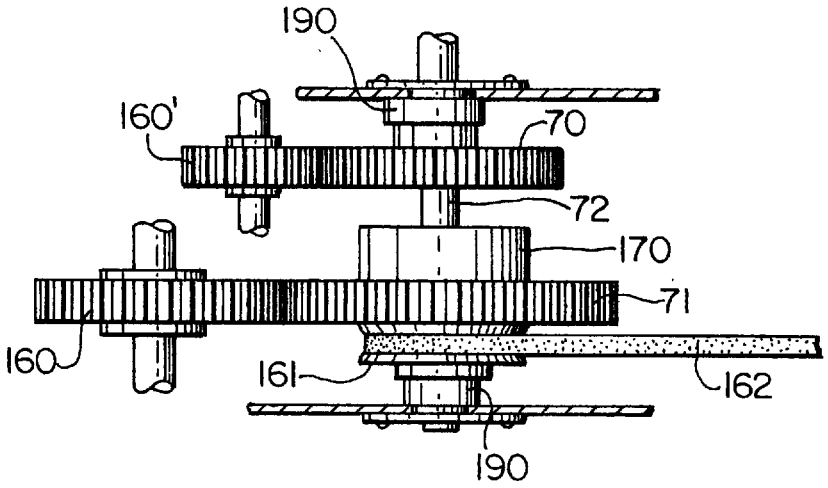
FIG. 5 is a top plain view of FIG. 4, illustrating structural configuration of major portion of a driving unit of one preferred embodiment of the present invention.

Turning now to the drawings and referring specifically to FIGS. 3 to 5, one preferred embodiment according to the principles of the present invention. The power of turning effect of motor gear 90 linked to main motor 9 is transmitted to joint gear 11 for driving sensitization via a plurality of power transmission gear interlocked therebetween, and in turn to sensitization driven gear and then register clutch gear.

Hence, when motor gear 90 starts to rotate, fixing roller 8 is initiated to rotate by driving power transmitted via power transmission gear, at a regulated rotational speed, and simultaneously, sensitization body 1 coaxially mounted with sensitization driven gear 10 is driven through sensitization register shaft 12 coaxially mounted with joint gear 11, and thereafter cleaner gear 121 which is driven by sensitization driven gear 10 is forced to rotate.

Meanwhile, power transmitted to register clutch gear 71 is transferred to feed roller gear 60 provided with timing pulley 161' which is interlocked with timing belt 162, driving feed roller 6, and in turn, to pickup roller gear 50 through feed roller gear 60 and power transmission gear 160 thereby driving pickup roller 5.

Clutch 170 and register roller gear 70 are engagedly connected to register shaft 72 of register clutch gear 71, as shown in FIG. 4. When clutch 170 is turned on responsive to a signal applied from controller 180, turning moment of register clutch gear 71 is, via clutch 170, transmitted register shaft 72, so as to rotate register roller gear 70. On the other hand, when clutch 170 is turned off, power is no longer transmitted to any portions of any roller. Here, clutch 170 is of ordinary electronic type and therefore details thereof are in public domain, drawings and explanation are thus omitted. Reference number 190 denotes bush for supporting register shaft.

When motor gear 90 is initiated to rotate by main motor 9, the turning effect thereof is transmitted to sensitization body 1, fixing roller 8, feed roller 6 and pickup roller 5 to drive respective portions, thereby causing a sheet to be picked up from cassette 140 so that it passes through register sensor 73 adjacent to register roller 7 through feed roller 6.

At this moment, register sensor 73 detects passing through of a sheet, generating a signal to controller 180, thereby allowing controller 180 to make clutch 170 turned on.

Once clutch 170 turned on, turning moment of register clutch 71 is transmitted to register shaft 72, driving register roller gear 70 engagedly fixed to register shaft 72, thereby driving register roller 7. In addition, the turning effect of register roller gear 70 is via idle gear 160' and power transmission gear 160, transmitted to drive magazine roller gear 30 and agitator gear 40, thereby driving magazine roller 3 and toner agitator 4.

Transfer instrument 110 transfers toner onto a sheet, and when completed, controller 180 turns off clutch 170, shutting down power transmission to register roller 7 and developing part 2, thereby allowing the sheet to be delivered through fixing roller 8. Accordingly, live loads applied to roller of respective portions, and particularly to main motor 9, are much lessened since power transmission to either developing part 2 and register roller 7 is completely blocked out, whereby permitting rotational gears worn more gradually and allowing to maintain stabilized operation.

Figure 6:
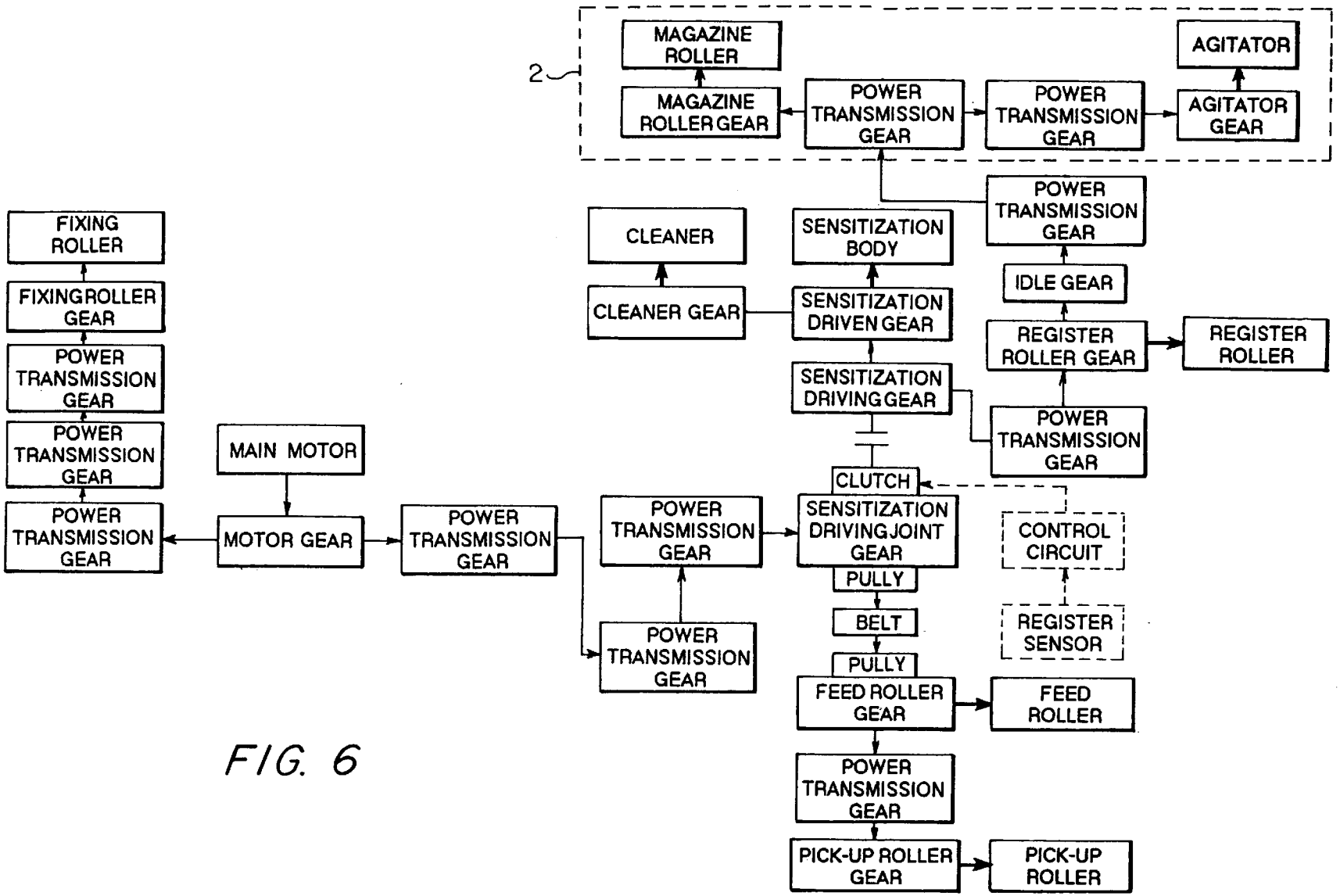
FIG. 6 is a block diagram illustrating a driving systematic drawing for another preferred embodiment according to the principles of the present invention.
Figure 7:
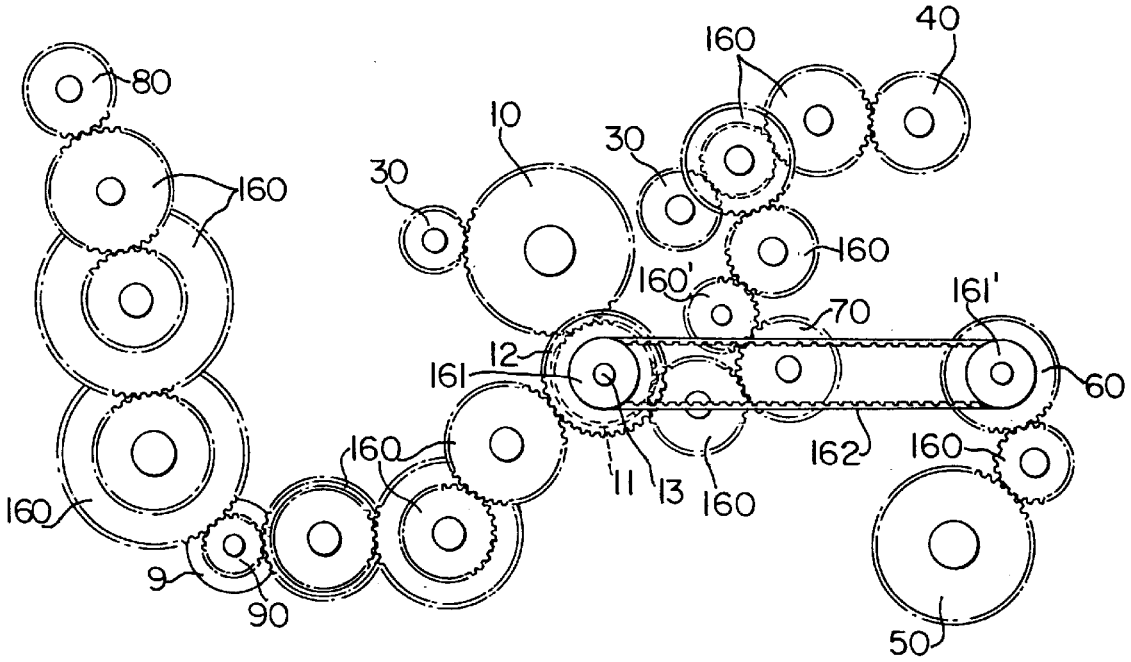
FIG. 7 is a schematic elevational view of a driving unit of the embodiment of FIG. 6.
Figure 8:
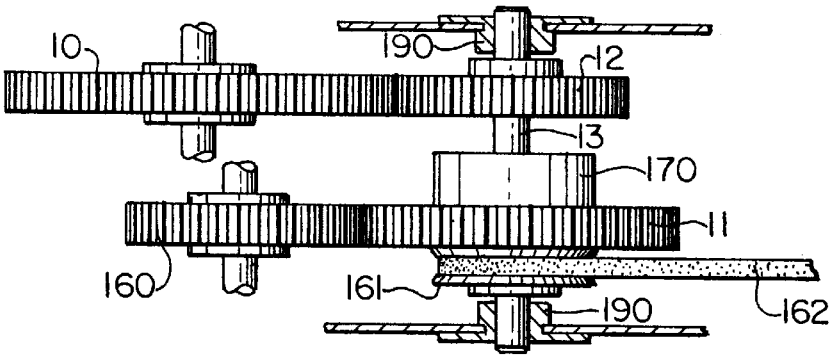
FIG. 8 is a top plain view of FIG. 7, illustrating structural configuration of major portion of a driving unit of another embodiment of the present invention.

Moving now on to FIGS. 6 to 8, another preferred embodiment according to the principles of the present invention is embodied in the illustration as an exemplar. Clutch 170 serving as a intermitting switch of power transmission of main motor 9, is engagedly installed coaxially on driving gear shaft 13 to which both sensitization driving joint gear 11 and sensitization driving gear 12 is coaxially mounted so as to intermit power transmission therebetween.

More specifically, as illustrated in FIG. 7, driving gear 12 is affixedly installed to driving gear shaft 13, and sensitization driving joint gear 11 continues to idle around driving gear shaft 13 until clutch 170 turns on. Clutch 170 allows sensitization driving joint gear 11 to transmit its turning moment onto driving gear shaft 13, thereby driving sensitization driving gear to rotate.

Timing belt 162 links interlockingly a couple of pulley 161 and 161' that are mounted on sensitization driving joint gear 11 and feed roller gear 60, respectively, so as to transmit power, and sensitization driving gear 12 transfers power to register roller gear 7. Other power transmission mechanism is same as that of one preferred embodiment and therefore detailed explanation is omitted for simplicity.

Moving now onto particular driving operation of another preferred embodiment, which will be explained in detail hereunder. Once motor gear 90 starts to rotate by power applied from main motor 9, then fixing roller 8, feed roller 6 and pickup roller 5 are driven to rotate, picking up and feeding a sheet, thereby turning on register sensor 73. Also clutch 170 is turned on by an operation of controller 180, allowing turning moment of sensitization driving joint gear 11 to be transferred to sensitization driving gear 12 via driving gear shaft 13, whereby sensitization body 1, cleaner 120, register roller 7 and developing part 2 is driven.

Clutch 170 is turned off by controller 180 as soon as the real end portion of a sheet passes through transfer instrument 110, causing operations of sensitization body and developing part 2 by blocking out power transmission, thereby lessening live load applicable to whole system and securing image printing quality.

As described and explained above, a driving system of an apparatus utilizing electrophotographic development is performed in two step, causing live load applied to driving system to lessen and a possible wear of gears to be reduced, thereby allowing an apparatus to employ a main motor of lower capacity, increasing overall performance and decreasing overhead, at a low cost. In addition, to the present invention requires relatively lesser accelerating torque at initial state of driving system, performing stabilized driving operation, thereby enhancing product reliability.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

What is claimed is:

1. A driving system in an apparatus utilizing electrophotographic development incorporating a main motor for generating and transmitting power to power transmission gears, said driving system is characterized in that a sensitization body, a pickup roller, a fixing roller and a feed roller are initially driven with power transmission from said main motor to developing part and to a register roller interrupted.

2. The driving system of claim 1, wherein said developing part and said register roller are driven by power transmitted from said main motor when a register sensor is activated by a sheet being fed by said feed roller, and said power is cut off when an image is transferred onto said sheet.

3. The driving system of claim 1, wherein power transmission from said main motor to said developing part and said register roller is interrupted by a clutch.

4. The driving system according to claim 3, wherein said clutch is engagedly installed coaxially on a register shaft so that power transmission, of said main motor from a register clutch gear to a register roller gear is transmitted, and is interrupted, via said register shaft.

5. A driving system of an apparatus utilizing electrophotographic development, the driving system incorporating a main motor for generating and transmitting power to a plurality of power transmitting gears, said driving system is characterized in that a pickup roller, a fixing roller and a feed roller are grouped to be initially driven with power transmission from said main motor to a developing part and to a register roller interrupted.

6. The driving system of claim 5, wherein a sensitization body, said developing part and said register roller are driven by power transmitted from said main motor when a register sensor is activated by a sheet being fed by said feed roller.

7. The driving system of claim 6, wherein power transmission from said main motor to said sensitization body, said register roller and said developing part is interrupted by a clutch.

8. The driving system according to claim 7, wherein said clutch is engagedly installed coaxially on a driving gear shaft so that power transmission of said main motor from a sensitization driving joint gear to a sensitization driving gear is transmitted, and is interrupted, via said driving gear shaft.

* * * * *